US006643856B2

(12) United States Patent
Valverde

(10) Patent No.: US 6,643,856 B2
(45) Date of Patent: Nov. 11, 2003

(54) BIDET ASSEMBLY

(76) Inventor: Donna L. Valverde, 9618 Fairdale La., Houston, TX (US) 77063

( * ) Notice: Subject to any disclaimer, the term of this patent is extended or adjusted under 35 U.S.C. 154(b) by 0 days.

(21) Appl. No.: 09/969,917

(22) Filed: Oct. 2, 2001

(65) Prior Publication Data

US 2003/0159206 A1 Aug. 28, 2003

(51) Int. Cl.[7] ..... A47K 3/20; A47K 4/00; E03D 9/08

(52) U.S. Cl. ..... 4/420.4; 4/420.5; 4/443; 4/448

(58) Field of Search ..... 4/420.4, 420.5, 4/443–448; 137/562, 843

(56) References Cited

U.S. PATENT DOCUMENTS 3,593,707 A * 7/1971 Pifer ..... 601/163

4,205,402 A * 6/1980 Miller ..... 4/448

* cited by examiner

*Primary Examiner*—Tuan N. Nguyen
(74) *Attorney, Agent, or Firm*—D'Ambrosio & Assoc. PLLC

(57) ABSTRACT

A bidet assembly includes a valving member collectively engageable to a water faucet of a sink. The valve assembly is manipulatable to permit water to pass through the valve assembly into the bowl of the sink or, alternatively, manipulatable to another position to permit fluid flow in one direction through the valve assembly into a flexible conduit and to a selectively positionable spray assembly of the bidet positioned within the bowl of a toilet around a top surface. The bidet assembly is secured on the top surface of the bowl of the toilet by means of a securing flap. The spray assembly may be oriented or aligned with the area of application of the spray onto the user.

5 Claims, 2 Drawing Sheets

BIDET ASSEMBLY

BACKGROUND OF THE INVENTION (1) Field of the Invention

The present invention relates to bidets mounted on a toilet bowl and, more particularly, pertains to a new bidet assembly for directing a stream of water towards the anus or the genital parts of an individual sitting on a toilet.

(2) Description of the Prior Art

The use of bidets mounted on a toilet bowl is known in the prior art. More specifically, bidets mounted on a toilet bowl heretofore utilized are known to consist basically of familiar, expected and obvious structural configurations not withstanding the myriad of designs encompassed by the crowded prior art that has been developed for the fulfilment of countless objectives and requirements.

Known prior art includes: U.S. Pat. Nos. 4,441,219; 4,422,189; 4,967,423; 4,691,391; 5,241,712; U.S. Design Pat. No. 355,246; and U.S. Pat. No. 6,178,568.

While these devices fulfill their respective, particular objectives and requirements, the aforementioned patents do not disclose a new toilet and bidet assembly wherein water may be flowed through the sink and selectively to the bidet, in a portable unit. The present invention addresses some of the deficiencies disclosed in the prior art.

SUMMARY OF THE INVENTION

A bidet assembly is provided for use with a toilet having a toilet bowl, a toilet seat, a toilet lid, and a toilet tank. The toilet bowl has a top surface portion and a bowl portion extending inwardly from the top portion. A main member is selectively coupleable to the toilet bowl surface. The main member has a flat mounting portion and a side flap for securement on the bowl top surface as well as a bidet portion. The bidet portion extends from the mounting portion into an interior space definded by the bowl portion of the toilet bowl. A selectively retractable spray nozzle is coupled to the bidet portion of the main member. The spray nozzle is positioned such that the spray nozzle may be adapted for directing water through the spray nozzle towards the anus or other portion of a user when the user is positioned on the toilet seat. The spray nozzle is selectively orientable relative to the anus area of the user and permits spraying of the water on the user when the user is seated on the toilet seat. A flexible conduit is provided which has a first end which may be coupled to the main member such that the first end of the conduit is positionable substantially coaxial to an axis about which said main member may pivot, whereby rotation of the flexible conduit causes it to pivot relative to the main member. A valve component is incorporated in the bidet assembly. The valve component includes a housing and means for selectively securing the housing to a water faucet extending through a sink, having a water bowl, or the like. The valve component also includes first and second fluid flow passage ways. One of the fluid flow passage ways permits fluid to flow between the faucet and into the bowl through the valve assembly. The second fluid flow passage way permits fluid to flow from the faucet through the apparatus and into the flexible conduit. Means are provided for selectively isolating the first and second passage way. The valve assembly also includes one-way check valve means for permitting fluid flow in the first fluid passageway in one direction and into the spray nozzle. The check valve also prevents fluid flow through the valve assembly in another direction, i.e., through the flexible conduit and into the valve assembly, to prevent possible contamination resulting from back pressure or surge as the valve or the water faucet is manipulated from one position to another position. A controller is positioned on an extension of the housing and is movable between first and second positions selective by opening and closing the first and second fluid flow passage ways. Biasing means extend between the controller and the housing of the valve assembly for urging a valve seat into one position blocking one of the fluid flow passage ways. The biasing means is moveable, such as by compression, to another position whereby another of the fluid flow passage ways is opened and the other of the fluid flow passage ways is closed.

DESCRIPTION OF THE PREFERRED EMBODIMENTS

Figure 1:
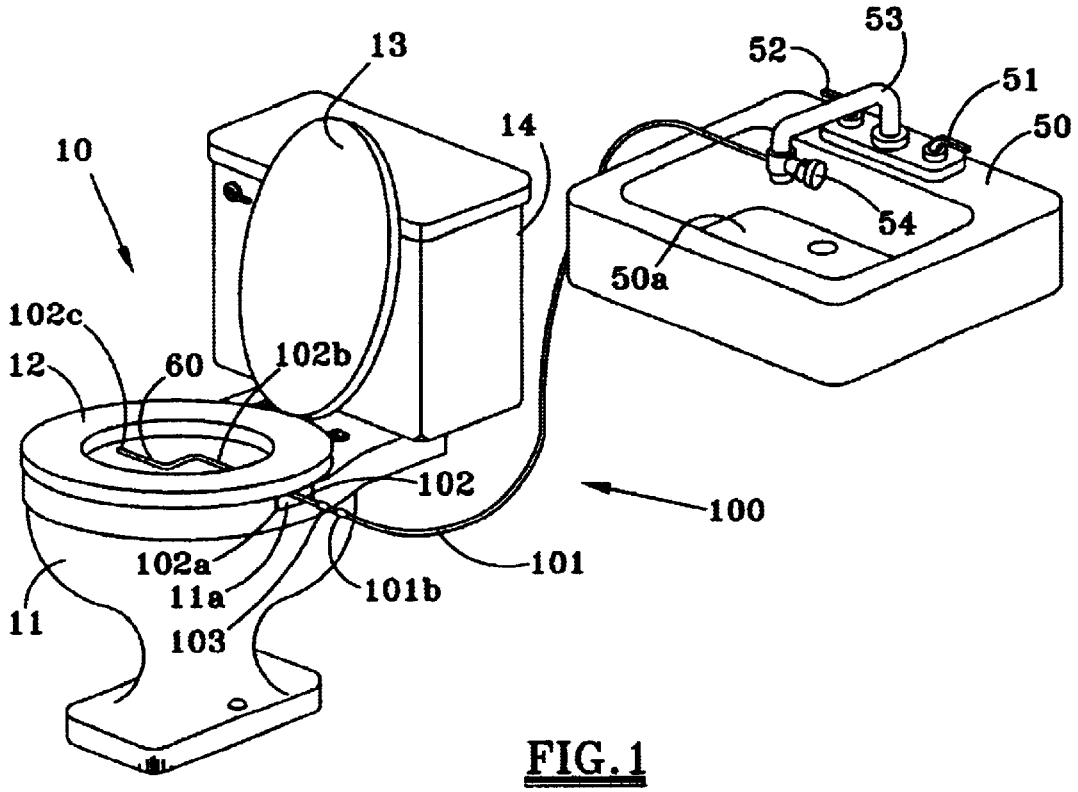
FIG. 1 is a perspective illustration of the apparatus of the present invention secured into the top surface of a bowl of a toilet having the valve assembly component engaged to a water arm of a sink.
Figure 2:
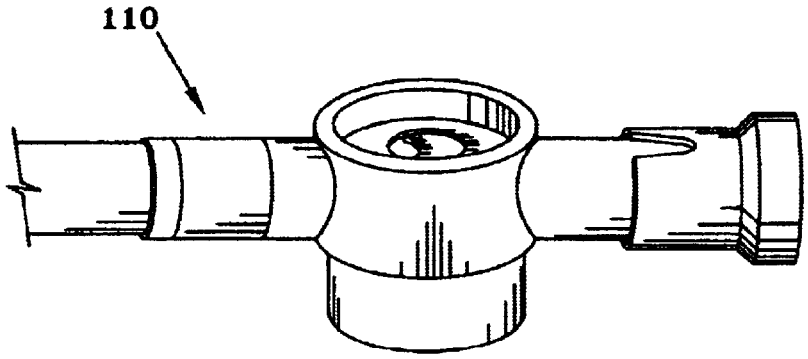
FIG. 2 is a perspective illustration looking downwardly upon the valve assembly with the controller being manipulated to the position as shown in FIG. 4.
Figure 4:
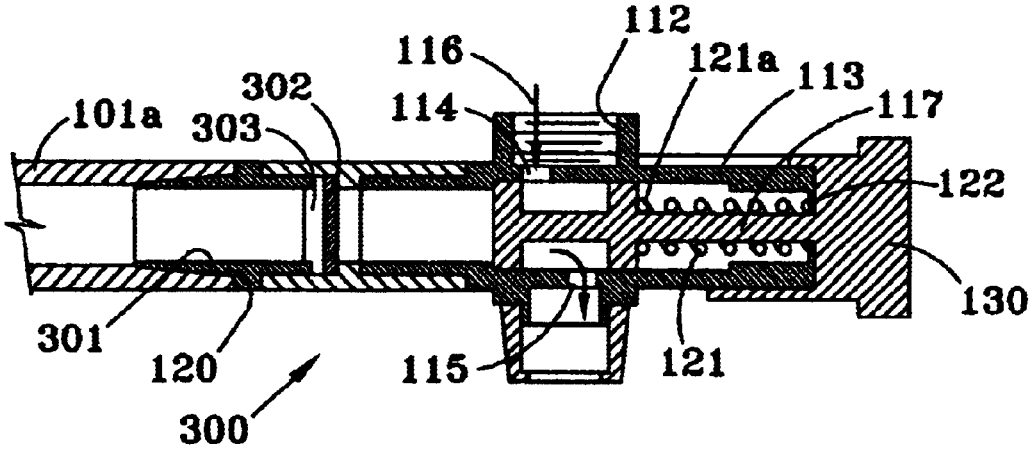
FIG. 4 is a cross-sectional illustration of the valve assembly and conduit as positioned in FIG. 2.

Now, with first reference to FIG. 1, there is shown the bidet apparatus 100 of the present invention. The bidet apparatus 100 comprises a flexible fluid conduit 101 having a conduit end 101*a* securable around a receiving surface 120 of valve assembly 110 (FIG. 4). The other end 101*b* of the flexible conduit 101 is secured to a connector 103 which, in turn, is secured to the outboard stiff conduit end 102*a* of the stiff conduit member 102. Stiff conduit member 102 is secured onto a plate 103 which is snugly secured across the top surface 11*a* of the toilet 10 by means of a substantially vertical flap on the outboard side of the top surface 11*a* of bowl 11.

The conduit end 101*b* extends to a bidet portion 60 having an off-set 102*b* continuing to a spray section 102*c* having openings for ejection of water from the valve assembly 110, through the flexible conduit 101 and interior of the conduit member or bidet portion 60.

The toilet 10, includes a lid 13, a seat 12 and a water compartment 14.

Now, with further reference to FIG. 1, the valve assembly 110 is secured onto threaded opening 54 of a water arm 53 extending from the sink 50. The sink 50 has a water bowl 50*a*. The sink 50 also has a hot water faucet 52 and a cold water faucet 51. Hot and cold water may be adjusted for a correct and satisfying temperature mixture through the faucets 51, 52 and through the water arm 53 into the valve assembly, with the temperature and flow of the water being checked and adjusted, as needed, by water transmitted through the valve assembly into the bowl 50*a* prior to its communication into the flexible conduit 101 and the bidet portion 60.

Figure 3:
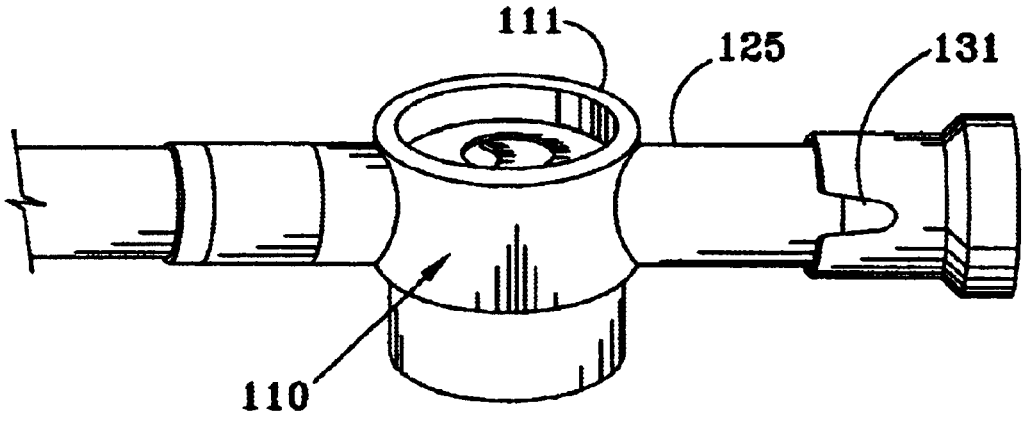
FIG. 3 is a view similar to that of FIG. 2 illustrating the valve assembly being manipulated to a position whereby the valve assembly is in position as shown in FIG. 5.
Figure 5:
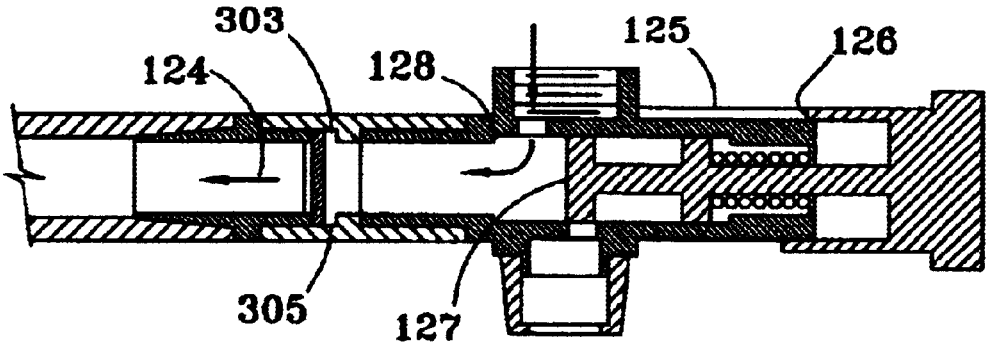
FIG. 5 is a cross-sectional view of the valve assembly similar to that of FIG. 4 and corresponding to the position of the valve assembly as shown in FIG. 3.

Now with reference to FIGS. 3, 4, and 5, the valve assembly 110 includes a housing 111 having a threaded opening 112 and a flow passageway 116 therein. A valve extension 113 forms part of the housing 111 of the valve assembly 110. The valve extension 113 has an upper port 114 and a lower port 115. The valve extension 113 also includes an inner, central shaft member 117 having a flow block, stopper, or seat 127 at one end thereof. The block or seat 127 is movably positionable on a seal shoulder 128 of the housing 111 when the shaft 117 is moved to its innermost position, blocking the flow of fluid from the water arm 53 into the valve assembly 110 through the upper port 114, but when in such position, fluid may pass through the fluid passage way 116 around the shaft 117 and into the lower port 115 of the shaft 117 and into the sink 50. A hand manipulatable valve controller 130 is disposed on the outboard-most end of the shaft 117. A shoulder 121*a* is provided on the interior of the valve extension 113 for receipt of a biasing means, such as a spring 121. Another end of the spring 121 rests upon the shoulder 122 of the shaft 117. A lower end or inward end 126 of the controller rests upon an outwardly facing shoulder of a retainer block 125 of the housing extension 113 as shown in FIG. 5 and FIG. 3. A v-cut 131 is provided in the controller 130 for selective companion engagement with the retainer block 125 (FIG. 3) and is rotatable away from the retainer block 125, as shown in FIG. 3 and FIG. 5. When the valve assembly is manipulated to the position shown in FIG. 5 from the position as shown in FIG. 4, passage way 124 will be defined through the valve assembly 110 threaded opening 112 into the upper port 114, thence through the inboard-most end of the valve assembly through the conduit end 101*a*, then to the flexible conduit 101 for discharge through the spray 102*c* of the bidet portion 60.

A one-way check valve 300 is included as an integral part of the valve assembly and includes a cylindrical housing 301 and a shuttleable valve head 302 therein moveable between sealed and unsealed positions relative to a valve seat surface 303 on the housing 301. When in the position shown in FIG. 6, the check valve blocks and prevents fluid flow from the spray of the bidet through the flexible line and thence through the valve assembly into the faucet arm, thus avoiding possible water contamination in the event of back surge or the like. However, when the valve head is displaced from its seat as the flow of water travels toward the spray element, water will flow around the valve head via by-pass passage 305 and into the flexible conduit.

Operation

When it is desired to use the bidet assembly, valve assembly 110 is threadedly secured on the threaded opening 54 of the water arm 53. Flexible conduit 101 is secured to the valve assembly 110 by means of the conduit end 101*a* being seemingly and snugly secured around the securing surface 120. The other end of the flexible conduit 101 is secured to the stiff conduit end 102 and the plate 103 snugly engaged onto the top surface 11*a* of the bowl 11 with the flap 104 being secured around the exterior surface 11*a*. The spray portion 102*c* may be rotatably aligned, as needed. The correct and comfortable mixture of hot and cold water is prepared by turning the valve assembly to the position shown in FIG. 4 and hot and cold water mixed by manipulation of the faucets 51, 52 for water ejection into the bowl 50*a*, as necessary. Thereafter, the user may position, him/herself upon the seat 12 and manipulate the controller 130 by hand to move the valve assembly from the position shown in FIG. 4 to the position shown in FIG. 5 for opening of the passage way 124. Now, the apparatus is in complete position for service, as desired.

Although the invention has been described in terms of specified embodiments which are set forth in detail, it should be understood that this is by illustration only that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A bidet assembly for use with a toilet having a toilet bowl, a toilet seat, a toilet lid and a toilet tank, said toilet bowl having a top surface portion and a bowl portion extending inwardly from said top portion, said bidet assembly comprising:

(1) a main member selectively couple able to said toilet bowl top surface, said main member having a flat mounting portion and a side flap for securement on said top surface, and a bidet portion, said bidet portion extending from said mounting portion into an interior space defined by said bowl portion of said toilet bowl;

(2) a selectively rotateable spray nozzle coupled to said bidet portion of said main member, said spray nozzle being positioned such that said spray nozzle is adapted for direction of water through said spray nozzle towards the anus of a user when the user is positioned on the toilet seat, said spray nozzle being selectively orientable relative to the anus area of the user for permitting spraying of water on the user when the user is seated on said toilet seat;

(3) a first conduit including an offset portion, said first conduit having a first end coupled to said main member such that the first end of said first conduit is positioned substantially co-axial to an axis about which said first conduit pivots relative to said main member whereby rotation of said first conduit pivots said offset portion for additional orientation relative to the user of said first conduit; and (4) a valve assembly including: a housing; a flexible water conduit selectively connectable to said housing and extending to said first conduit; means for selectively securing said valve assembly to a water faucet extending through a sink having a water bowl; first and second fluid flow passage way within said housing; said first fluid flow passageway selectively transmitting flow of water from said faucet, through said valve assembly through said flexible conduit; said second fluid flow passage selectively transmitting fluid flow from said faucet to said bowl; means for selectively blocking one of said fluid flow passage ways and opening the other of said fluid flow passage ways; said housing further including one way check valve means for permitting fluid flow in said first fluid flow passageway in one direction and into said spray nozzle and for preventing fluid flow through said valve assembly in another direction through the flexible conduit and into said valve assembly.

2. The assembly of claim 1 wherein said valve assembly further includes first and second water ports through said housing and a shuttleable valve seat movable between first and second positions for selectively establishing and blocking fluid flow through said first and second flow passage ways.

3. The assembly of claim 2 wherein said valve assembly further comprises a shaft extendable within said housing and secured to said valve seat on one end and secured to a hand manipulable controller at the other end of said shaft; biasing means between said housing and said shaft for urging said shaft and said controller in a first direction and compressible in a second direction while manipulating said valve head between first and second positions.

4. The assembly of claim 3 wherein said controller includes a profile therein and said valve controller is selectively engageable around and said assembly further includes a protruding retainer block positioned exteriorly on said housing and wherein said shaft is moved to permit fluid flow through one of said first and second flow passage ways to prevent fluid flow in the other of said first and second flow passage ways and, whereby, said controller may be hand manipulated to move said profile to disengaged position relative to said retainer block to manipulate said shaft and to prevent fluid flow through said first flow passage way and permit fluid flow through said second flow passage way.

5. A valve assembly adaptable for use in a bidet assembly engageable to a water faucet of a sink, comprising: a housing; a flexible water conduit selectively connectable to said housing and extending to the bidet assembly; means for selectively securing said valve assembly to a water faucet extending through a sink having a water bowl; first and second fluid flow passageways within said housing; said first fluid flow passageway selectively transmitting flow of water from said faucet through said valve assembly through a flexible conduit extending to said bidet assembly; said second fluid flow passageway selectively transmitting fluid flow from said faucet to said bowl; means for selectively blocking one of said fluid flow passageways and opening the other of said fluid flow passageways; said housing further including one way valve means for permitting fluid flow in said first fluid flow passageway in one direction and into said spray nozzle and for preventing fluid flow through said valve assembly in another direction through the flexible conduit and into said valve assembly.

* * * * *